US005503502A

United States Patent [19]

Parsons

[11] Patent Number: 5,503,502

[45] Date of Patent: Apr. 2, 1996

[54] METHOD OF FORMING A TEMPORARY VEHICLE-BEARING SURFACE

[75] Inventor: Howard W. Parsons, Stroud, United Kingdom

[73] Assignee: Netlon Limited, Blackburn, United Kingdom

[21] Appl. No.: 394,009

[22] Filed: Feb. 23, 1995

[30] Foreign Application Priority Data

Dec. 8, 1994 [GB] United Kingdom ..... 9424781

[51] Int. Cl.[6] ..... E01C 11/24; E02D 17/20

[52] U.S. Cl. ..... 405/258; 404/20; 404/72

[58] Field of Search ..... 405/258; 428/240, 428/241; 404/19, 20

[56] References Cited

U.S. PATENT DOCUMENTS

| | | | |
|---|---|---|---|
| 2,919,467 | 1/1960 | Mercer | 264/167 |
| 3,252,181 | 5/1966 | Hureau | 425/224 |
| 3,400,644 | 9/1968 | Baskin | 404/20 |
| 3,795,180 | 3/1974 | Larsen | 405/36 |
| 4,020,211 | 4/1977 | Eigenmann | 404/19 X |
| 4,662,972 | 5/1987 | Thompson | 404/19 X |
| 4,992,003 | 2/1991 | Perach | 405/258 |

FOREIGN PATENT DOCUMENTS

| | | |
|---|---|---|
| 2131842 | 11/1972 | France . |
| 2255292 | 11/1992 | United Kingdom . |

*Primary Examiner*—Stephen J. Novosad
*Attorney, Agent, or Firm*—Jacobson, Price, Holman & Stern

[57] ABSTRACT

In order to provide a good traction surface for vehicles and a good non-slip surface for pedestrians, a temporary vehicle-bearing surface is formed by laying directly on a grassed soil surface a heavy duty plastics geonet with a gritted upper face, and securing the geonet to the soil beneath with hooked pegs. Grass can than grow through meshes in the geonet and can be mown and fertilised.

3 Claims, 4 Drawing Sheets

METHOD OF FORMING A TEMPORARY VEHICLE-BEARING SURFACE

BACKGROUND OF THE INVENTION

The present invention relates to a method of forming a temporary vehicle-bearing grassed surface. It is known to use heavy duty plastics nets in order to form a temporary vehicle-bearing surface on a grassed soil surface. The nets can provide sufficient traction for the vehicles and also spread the load and limit damage to the surface. However, when the occupants of the vehicles leave their vehicles, and when other pedestrians walk on the surface, there is a significant danger that they may slip as the net is extremely slippery, particularly when wet.

The Netlon leaflet "Reinforcement of turf" describes the use of a heavy duty net or geonet which is laid flat on a prepared surface, secured with steel pins, and then just covered with a thin layer of sandy top soil, traffic being kept off the area until new grass has been mown twice. U.S. Pat. No. 3,795,180 describes the use of a drainage net on a sloping surface in order to permit run off within the plane of the drainage net. If the net is used on a natural surface (the example is tamped earth), an impervious sheet is laid below to ensure proper flow-off. There is a description of incorporating grit in the upper surface of the drainage net by softening the net under heat and applying the grit with slight pressure; such a gritted net provides a friction surface for walking.

THE INVENTION

According to the present invention, there is laid directly on a grassed surface a heavy duty plastics net whose mesh openings form at least about 60% of the plan view area of the net and whose upper face comprises portions firmly retaining projecting, hard, angular particles of grit, the net being secured to soil beneath. Subsequently, the grass continues to grow, and as it grows up through the meshes of the net, it can be mown and fertilised. The relatively large open area formed by the relatively large percentage of mesh opening, permits healthy and dense growth of grass.

The invention can be applied to any suitable grassed soil surface, such as playing fields or sports fields or meadows, wherever a temporary vehicle-bearing surface is required. The grass is preferably not cut immediately prior to laying the net as the bent over grass beneath the net gives better support. When laying the net, it should not be covered with soil as this will remove all the benefit of the gritting. The gritted net appears to perform equally well whether wet or dry as the grit provides a non-slip surface for pedestrians whilst the soil surface is still protected from vehicle damage by the load spreading of the net. There is also the beneficial effect due to the gritting of the net in that vehicle wheel skidding is reduced. At the same time, as the grass can grow up through the net meshes, and as the net is more or less level with the surface of the soil, the appearance of the grassed surface remains relatively unchanged and the net is not very visible. As there is no impervious layer beneath the net, water passes normally into the soil below and the grass grows normally. There is no requirement for the net to be on a slope, and the net can be used on the level or on a slope as required. As there is no drainage in the plane of the net, the net does not need to be and preferably is not a drainage net, i.e. need not and preferably does not have the correct profile for a drainage net which maintains uninterrupted drainage channels in the plane of the net. This provides a corresponding advantage in that it is not necessary to have one set of strands of the net standing proud and portions of both sets of strands can be gritted, therefore gritting more surface area. The grit can be applied to each of two parts of each of two crossing or intersecting sets of strands on the uppermost faces of both sets of strands. Both sets of strands will in part engage the ground and help prevent the net moving in any direction over the ground.

As there is no requirement to support one set of strands to leave drainage channels beneath, the mesh sizes need not be particularly small and the percentage open area is chosen so as to permit free growth of the grass up through the meshes, which in itself is beneficial because the grass hides the net although the grit is such that when walked upon, even though there may be wet grass beneath the sole of the foot, the net still prevents slipping. Nonetheless, the mesh size should be sufficiently small to prevent the wheels of wheeled mowing machines indenting the net by a sufficiently large amount to cause the mowing machine to cut the net. The maximum dimension of a mesh opening is preferably greater than about 14 mm. The maximum dimension of a mesh opening is preferably less than about 35 mm. The minimum dimension of a mesh opening is preferably greater than about 10 mm. The minimum dimension of a mesh opening is preferably less than about 30 mm.

As the net will be subject to relatively large forces in its plane due to braking or acceleration of vehicles, it should be properly secured to the soil beneath, for instance using hooked pegs. As the grit will also be subject to such forces, it should be firmly retained in the upper face of the net, and this is best done by heating the grit particles and applying the grit particles to a cold net as this melts just restricted zones of the net upper surfaces and causes the plastic to lip up around the respective particles and retain them firmly whilst leaving the particles projecting well above the general surface of the net—in this way, the grit can still be effective even though it is overlaid with grass. This way of incorporating the grit enables the grit to be incorporated without significantly weakening the strands.

The net can be laid as a very short term measure, for instance for just one day, but can be laid for longer periods of say two weeks or for a whole season.

The net should be strong enough to withstand traction from motor car types, which is probably the most rigorous duty that the net would have to perform, and it is preferred that the strands have a diameter of at least about 2 mm, or alternatively that the net have a weight of at least about 300 $gm/m^2$. Such nets will be known as heavy duty nets, and can be termed geonets. The nets are preferably non-oriented and would normally be made of a thermoplastic such as HDPE (high density polyethylene) or PF (polypropylene) copolymer.

The net can be of any suitable structure, such as diamond, square (or rectangular), trellis or oscillated, and can be made by any suitable procedure, though integral nets are preferred. Suitable procedures are those described in U.S. Pat. No. 2,919,467, FR 2 131 842 or U.S. Pat. No. 3,252,181.

Any suitable grit can be used, provided it is hard and angular and will penetrate into or indent the face of the type or footwear sole in contact with the net; for instance the grit can be powdered or fractured glass as used in glass-paper, very sharp angular sand as used in sandpaper, or aluminium oxide as used in emery paper. It is preferred that the grit particles should be in a single layer. Any suitable range of sizes can be used, but the preferred maximum particle size is about 1 mm or 0.6 mm though larger particles can be used;

it is preferred that the largest particles have a particle size of at least about 0.4 mm, one preferred size being about 0.7 mm maximum dimension.

PREFERRED EMBODIMENTS

The invention will be further described, by way of example, with reference to the accompanying drawings, in which.

FIGS. 1 AND 2

Figure 1:
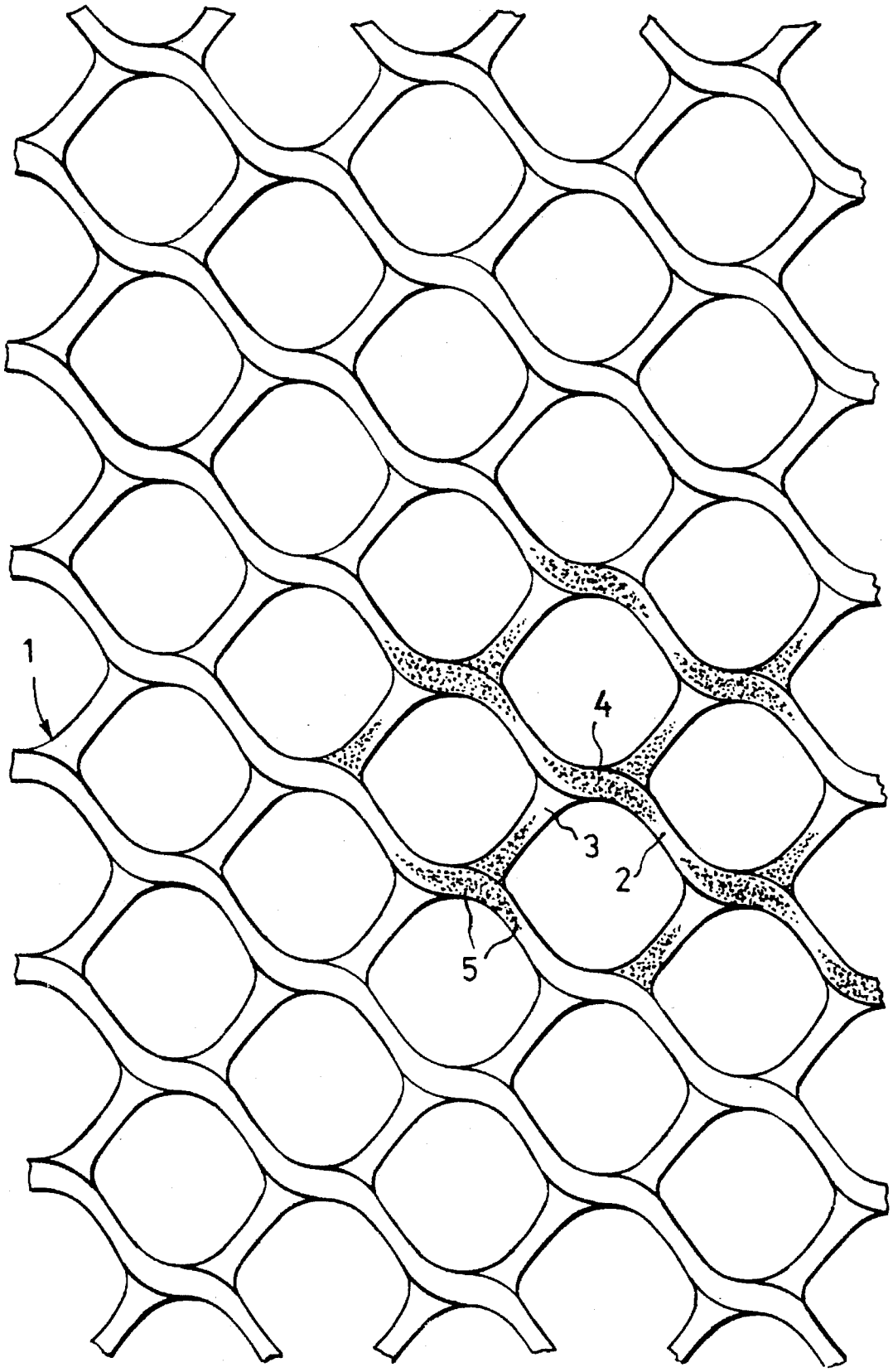
FIG. 1 is a plan view, partly schematic, of a gritted net used in accordance with the invention.

FIG. 1 shows a "Netlon"CE 131 unoriented heavy duty net or geonet 1 made of HDPE using counter-rotating dies as described in U.S. Pat. No. 2,919,467. The strands have an average diameter of 3 mm. The geonet 1 is of diamond construction and in effect, the geonet 1 is formed of two sets of crossing strands 2, 3, extending roughly at 90° to each other. The geonet 1 is biplanar through the strands are so widely spaced that drainage channels are not maintained and the strands 2, 3 flex significantly between crossing points or intersections 4. The pitch of the strands 2, 3 is roughly 32 mm. The maximum minimum dimensions of a mesh opening are roughly 28 and 27 mm respectively. The weight of the geogrid 1 is about 600 gm/m$^2$. The mesh openings form about 80% of the plan view area of the geonet 1.

As indicated in FIG. 1, grit particles 5 are applied to the upper face of the geonet 1, and extend over the intersections 4 and over parts of the strands 2, 3. Due to the way in which the grit 5 is applied, and due to the relatively wide spacing of the strands 2, 3, the grit is distributed fairly equally between those parts of the strands 2, 3 which lie between the intersections 4.

Figure 2:
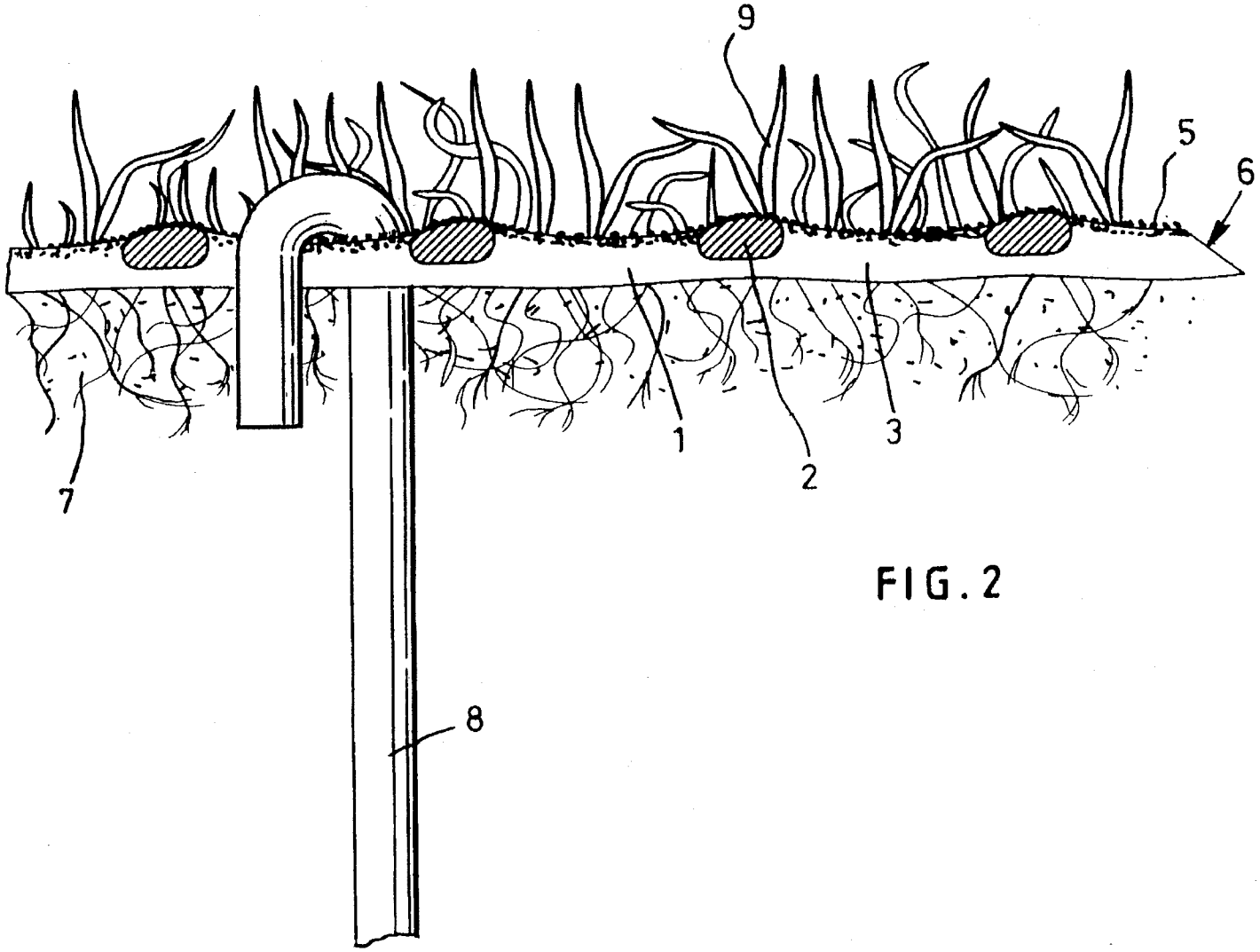
FIG. 2 is a vertical section, enlarged relative to FIG. 1, through a temporary vehicle-bearing surface provided by the method of the invention.

FIG. 2 illustrates a temporary vehicle-bearing surface 6 after the geonet 1 has been laid on soil 7 which had a grassed surface, and has been secured down to the soil 7 using hooked pegs 8. Grass 9 has grown up through the meshes in the geogrid 1, and can be mown and fertilised.

FIGS. 3 TO 5

Figure 3:
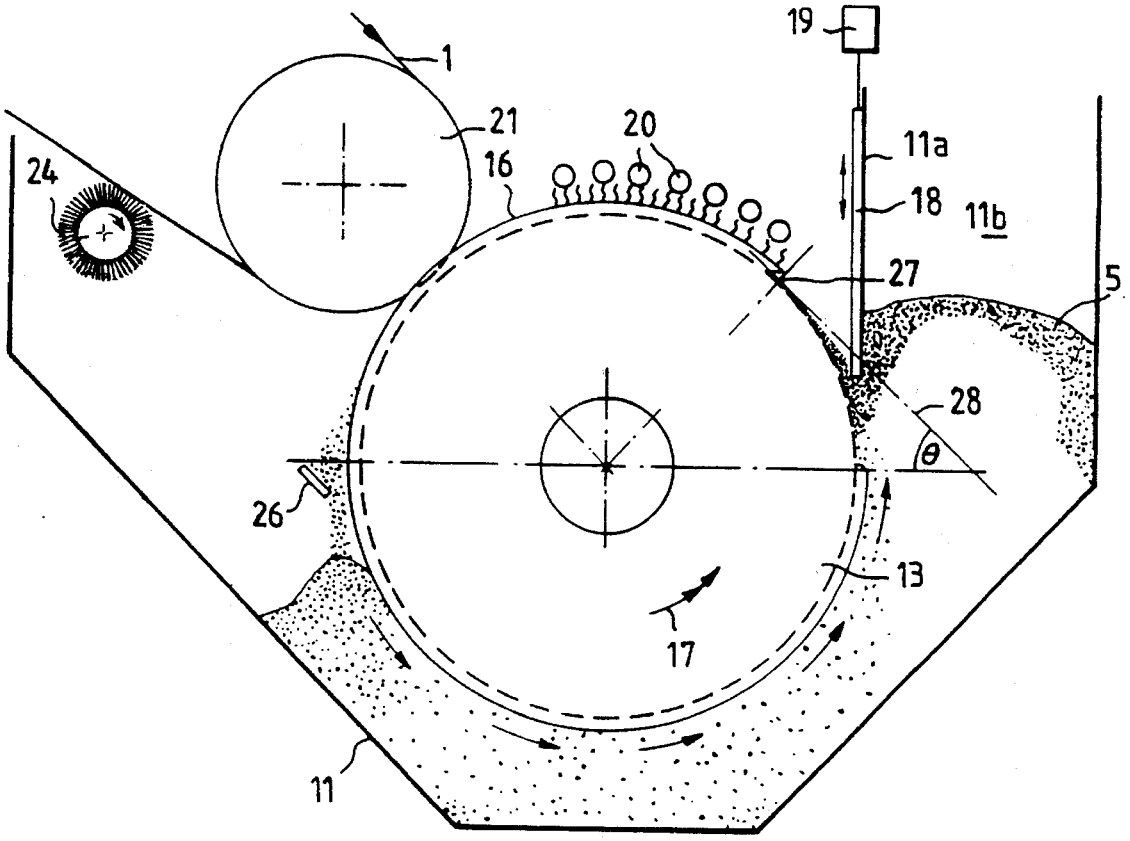
FIG. 3 is a vertical section through a gritting machine in accordance with the invention, along the line III—III in FIG. 4.
Figure 4:
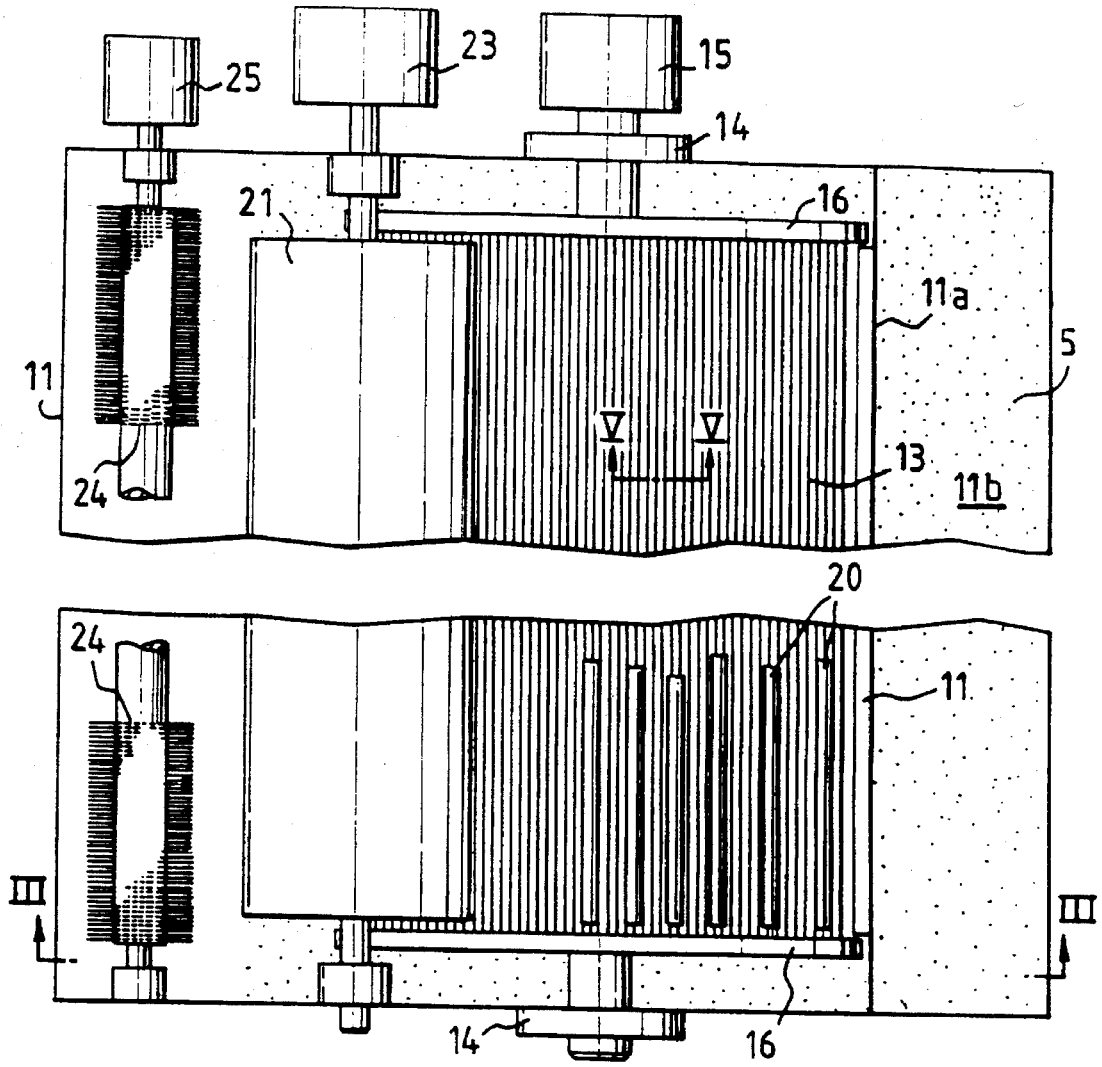
FIG. 4 is a schematic plan view of the gritting machine of FIG. 3.
Figure 5:
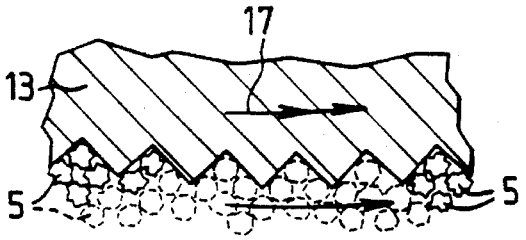
FIG. 5 is a detail, taken in vertical section along the line V—V of FIG. 4, showing the knurling on the roller.

FIGS. 3 to 5 show a machine for gritting the geonet 1. The machine has a container 11 (which includes a cross-wall 11*a* defining a hopper 11*b*) containing grit particles 12. A roller 13 is mounted for rotation about a horizontal axis by means of bearings 14 which are protected from the grit particles, and rotating means or a drive 15 is indicated schematically. The peripheral surface of the roller 13 is knurled so as to have grooves extending parallel to the axis (see FIG. 5). The roller 13 has smooth flanges 16 (the near flange 16 is shown partly cut-away in FIG. 3 to minimise fall-off from the sides of the roller 13, and to ensure a more constant thickness of the grit particles up to the edges of the roller 13. If the level of the mass of grit particles 12 on the ascending side of the roller 13 is suitably chosen (and not too high), the pick-up by the flanges 16 is minimal. The direction of rotation of the roller 13 is indicated by a double-headed arrow 17. A vertically-moveable control member or gate 18 is mounted in the container 11 adjacent the ascending side of the roller 13 and defines one side of the hopper 11*b*. The gate 18 is for adjusting the level of the surface of the mass of grit particles 12 adjacent the ascending part of the roller surface. A gate height adjuster 19 is shown schematically in FIG. 3. Over the upper part of the roller peripheral surface (as shown, over the uppermost 45° of the ascending part of the roller peripheral surface and also preferably beyond the centre line of the roller 13) there is a bank of halogen infra-red emitters 20 shown partially cut-away in FIG. 4, for heating the grit particles 12 on the upper part of the roller peripheral surface. A cover (not shown) is provided for the radiant heaters 20. Adjacent the upper quadrant of the descending part of the roller peripheral surface, there is a guide roller 21 which guides the thermoplastic net 1 in a path which brings it into a contact zone over the part of the guide roller 21 which is nearest the main roller 13, where it contacts grit particles 12 on the main roller 13. The guide roller 21 is an idle roller driven by the moving net 1 which is driven by another drive roller (not shown). The axis of the guide roller 21 can be moved to adjust the gap between the guide roller 21 and the main roller 13. In the contact zone, the net 1 and the peripheral surface of the roller 13 are moving at substantially the same speed and in the same direction. The net 1 can have the same width as the guide roller 21 (which is slightly narrower than the main roller 13) or be narrower, as desired. A rotary brush 24 is provided for brushing off excess grit particles, a drive 25 being indicated schematically. A thermocouple 26 is placed downstream of the contact zone and below the level of the axis of the roller 13 so that it is in the path of falling grit particles 12 as they tend to fall off the surface of the roller 13.

The container 11 is such that there is sufficient distance between the bottom of the roller 13 and the bottom of the container 11 to avoid any significant pressure against the roller 13 and consequent grinding of the surface of the roller 13.

FIG. 3 indicates the pick-up point 27 and the tangent 28 to this point 27, which is at an inclination of 74 to the horizontal. The gate 18 is adjusted so that it is intercepted by the tangent 28.

The single-headed arrows indicate laminar flow of the grit particles 12 under and close to the roller 13, from the descending part of the roller 13 to the ascending part.

Though not shown, a sprayer or a coating roller can be included after the rotary brush 24 for applying to the net 1 a thin retaining coating, e.g. having a thickness not greater than 0.1 mm, to hold in place any grit particles 12 which are not properly keyed in position, to avoid dislodging such particles during handling. The coating can be flexible varnish or latex. The sprayer or coating roller can be followed by suitable dryers (not shown).

EXAMPLE

Material of net 1: HDPE, melting at 135° to 140° C.

Gap between roller 21 and roller 13: equals thickness of net 1.

Diameter of roller 13: 508 mm.

Material of roller 13: mild steel.

Diameter of roller 21: 254 mm.

Material of roller 21: mild steel.

Speed of roller 13: such as to provide a surface velocity of 5 m/minute (equal to the speed of the net 1), which could be increased to 10 m/minute.

Width of roller 13: up to 3 m.
Depth of flanges 16: 12 mm.
Grit size: all passes through 40 mesh to inch sieve (maximum dimension about 700 microns).
Knurling trough-to-crest: 1 mm.
Knurling crest to crest distance: 1.625 mm.
Knurling trough angle: 75°.
Pick-up point: 43° before top dead centre of roller 13.
Grit fall-off point: 47° after top dead centre of roller 13.
Angle 74 : 43°.
Guide roller 21 position: axis is 45° from top dead centre of roller 13.
Radiant heaters 20: halogen infra-red emitters of heating capacity 25 kW per meter width of the roller 13 (for a speed of 5 m/minute).
Pass time under the halogen infra-red emitters 20: 2.4 seconds.
Grit temperature in contact zone: 280°–300° C.
Grit temperature at thermocouple 26: 250° C.
Position of gate 18: the surface facing the roller 13 is on a plane which is spaced 12.5 mm from the nearest part of the roller surface.
Height of the bottom of the gate 18: 104 mm above the axis of the roller 13.

The present invention has been described above purely by way of example, and modifications and be made within the spirit of the invention.

The disclosures of U.S. Pat. No. 2,919,467 to Frank Brian Mercer, of U.S. Pat. No. 3,252,181 to Jacques Hureau and of U.S. patent application Ser. No. 07/877,143 by Frank Brian Mercer et al are incorporated herein by reference.

I claim:

1. A method of forming a temporary vehicle-bearing surface on a grassed soil surface, the method comprising:

laying directly on the grassed surface a heavy duty plastics net defining mesh openings which form at least 60% of the plan view area of the net, said net defining an upper face which comprises portions firmly retaining projecting, hard, angular particles of grit;

securing said net to said soil beneath said net; and permitting grass to grow;

thereby providing a good traction surface for vehicles and also a good non-slip surface for pedestrians.

2. The method of claim 1, wherein the grass is permitted to grow up through meshes in the net, and the grass is subsequently mown.

3. A method of forming a temporary vehicle-bearing surface on a grassed soil surface, the method comprising:

laying directly on the grassed surface a heavy duty net defining mesh openings which have a maximum dimension and a minimum dimension, said maximum dimension being greater than about 14 mm and less than about 35 mm and said minimum dimension being greater than about 10 mm and less than about 30 mm, said mesh openings forming at least 60% of the plan view area of the net, said net defining an upper face which comprises portions firmly retaining projecting, hard, angular particles of grit;

securing said net to said soil beneath said net; and permitting grass to grow;

thereby providing a good traction surface for vehicles and also a good non-slip surface for pedestrians.

* * * * *